US006431506B1

(12) United States Patent
King et al.

(10) Patent No.: US 6,431,506 B1
(45) Date of Patent: Aug. 13, 2002

(54) INSERT FOR GAZING BALL

(75) Inventors: Courtney A. King, Ypsilanti, MI (US); Keechang Han, Shanghai (CN)

(73) Assignee: Bird Brain, Inc., Ypsilanti, MI (US)

( * ) Notice: Subject to any disclaimer, the term of this patent is extended or adjusted under 35 U.S.C. 154(b) by 0 days.

(21) Appl. No.: 09/518,589

(22) Filed: Mar. 3, 2000

(51) Int. Cl.[7] ..... A45F 3/44; B06B 17/08

(52) U.S. Cl. ..... 248/156; 239/17; 239/211; 239/251; 285/148.23

(58) Field of Search ..... 248/156; 239/251, 239/261, 258, 16, 17, 18, 241, 264, 246; D23/201; 285/148.23; 411/344, 345, 346, 340, 182, 508, 509

(56) References Cited

U.S. PATENT DOCUMENTS

| | | | | | |
|---|---|---|---|---|---|
| 515,625 | A | | 2/1894 | Stott | |
| 545,857 | A | | 9/1895 | Fritz | |
| 632,540 | A | | 9/1899 | Sampson | |
| 685,110 | A | * | 10/1901 | Crouch | 239/18 |
| 1,901,391 | A | * | 3/1933 | Forberg | 411/344 |
| 2,084,817 | A | | 6/1937 | Lombard | |
| 2,979,272 | A | | 4/1961 | Thorrez | |
| 3,385,525 | A | | 5/1968 | Jacobs | |
| 4,100,833 | A | * | 7/1978 | Nessa | 411/340 |
| 4,452,836 | A | | 6/1984 | Daniel, Jr. | |
| 4,530,630 | A | | 7/1985 | Brown | |
| D284,785 | S | | 7/1986 | Lemkin et al. | |
| 4,809,477 | A | * | 3/1989 | Gasser | 52/410 |
| D302,458 | S | | 7/1989 | Locklair, Jr. | |
| 4,944,476 | A | | 7/1990 | Olson | |
| 4,978,964 | A | | 12/1990 | Castille | |
| D321,746 | S | | 11/1991 | Cockman | |
| 5,165,538 | A | | 11/1992 | Peters | |
| 5,209,621 | A | * | 5/1993 | Burbridge | 411/340 |
| 5,224,652 | A | | 7/1993 | Kessler | |
| 5,308,204 | A | * | 5/1994 | Moen | 411/37 |
| 5,425,609 | A | * | 6/1995 | Smith | 411/344 |
| 5,505,380 | A | * | 4/1996 | Jun | 239/211 |
| 5,509,765 | A | * | 4/1996 | Albin | 441/38 |
| D412,964 | S | | 8/1999 | Krueger | |
| 5,944,466 | A | * | 8/1999 | Rudnicki et al. | 411/344 |
| 6,015,098 | A | | 1/2000 | Krueger | |
| 6,109,546 | A | | 8/2000 | Ormiston | |
| 6,202,937 | B1 | * | 3/2001 | King | 239/17 |
| 6,302,335 | B1 | * | 10/2001 | Ormiston et al. | 239/214 |
| 6,325,303 | B1 | * | 12/2001 | Kuo | 239/17 |
| 6,347,751 | B1 | * | 2/2002 | Kuo | 239/17 |

* cited by examiner

*Primary Examiner*—Anita King
*Assistant Examiner*—Naschica S Morrison
(74) *Attorney, Agent, or Firm*—Young & Basile, P.C

(57) ABSTRACT

An adapter assembly for mounting a hollow glass ornament such as a blown glass gazing ball onto a support structure, for example an upright sprinkler. The adapter assembly includes a cylindrical plastic body having a first end adapted to mate with a base opening in the glass gazing ball, and a second end adapted to fit into the support. A bolt is rotatably inserted through the adapter body, and its threaded tip engages a flexible retaining piece comprising an elongated strip of rubber-like material having a nut held therein for receiving the bolt. The flexible retaining piece is pre-assembled to the tip of the bolt, and then inserted endwise into the gazing ball opening until the adapter assembly can be rotated downwardly and then pushed axially into the opening while the second end of the flexible retaining piece is bent against the adapter assembly and pushed through to the interior where it unfolds. Once unfolded, and once the bolt is then further threaded through the retaining piece, the flexible retaining piece is tensioned in conforming fashion against the inside surface of the glass gazing ball, thereby holding the plastic adapter body securely against the gazing ball base.

7 Claims, 3 Drawing Sheets

FIG-2
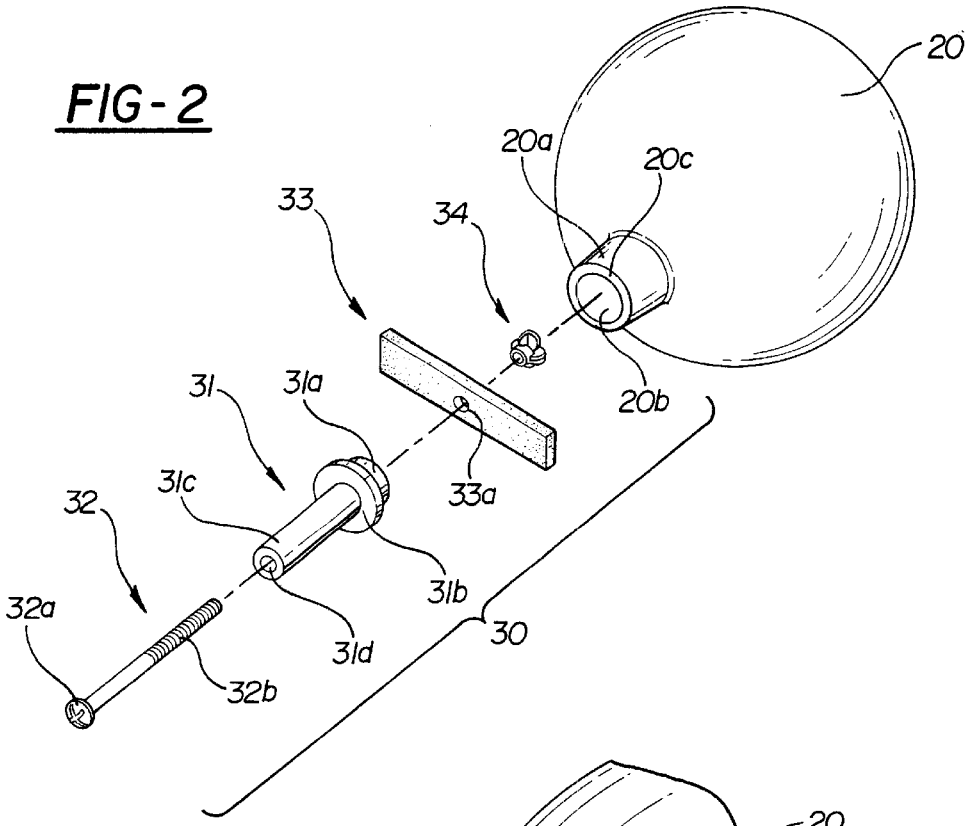
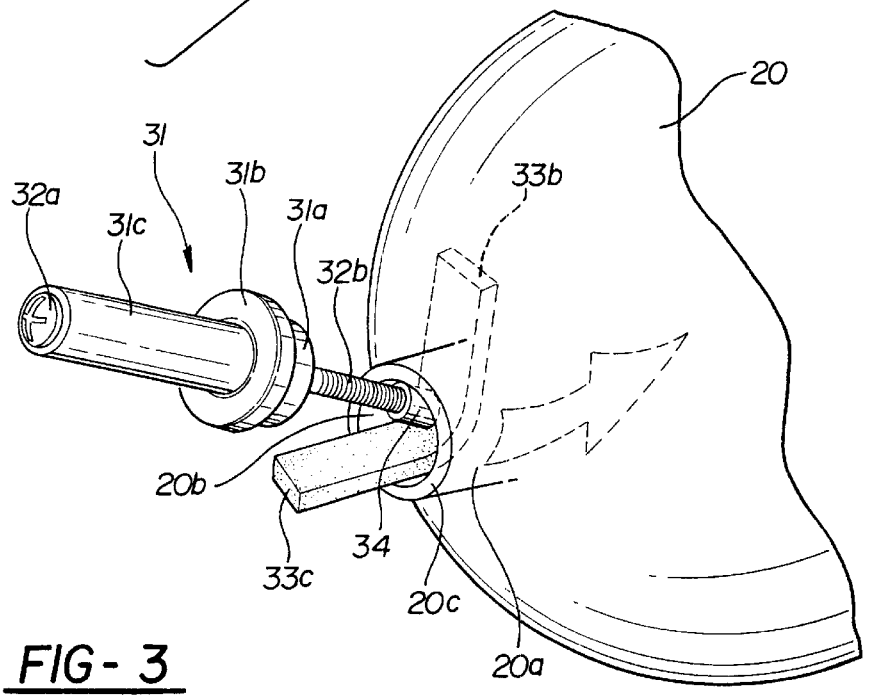
FIG-3

INSERT FOR GAZING BALL

FIELD OF THE INVENTION

The present invention is in the field of insert-type attachment structures for glass ornaments and bulbs, in particular for the "gazing ball" type used on upright supports such as rotating sprinklers.

BACKGROUND OF THE INVENTION

Tall, upright, sculpture-like sprinklers have been around for many years and are becoming very popular. These sprinklers typically comprise a tube-fashioned, artistically-shaped sprinkler head rotatably mounted on the top of a vertical standpipe of several feet in length, which in turn is secured to the ground and supplied with water from a hose. Water from the standpipe flows into appropriate tubing on the sprinkler head, and exits from a pattern of spray holes which causes the sprinkler head to rotate on top of the standpipe.

A common style of sprinkler head uses a circular outer water tube perforated with spray holes in a pattern designed to throw an aesthetically pleasing and rotation-causing spray of water. The area circumscribed by the water tubing is often filled with decorative ornamentation, for example a blown glass gazing ball or bulb of brightly colored glass.

A difficulty lies in connecting the glass piece to the sprinkler head, and further in securing an adapter appropriate for the connection to the glass piece.

SUMMARY OF THE INVENTION

The present invention is an apparatus and method for securing a support mounting adapter to the base or stem of a glass bulb with a removable mechanical connection. The adapter comprises a plug portion adapted to fit into and seat or seal against the typically cylindrical opening or hollow stem formed at what will be called the "base" of the bulb during a glass blowing or similar manufacturing process. The adapter further includes a body extending from the plug portion and sized and shaped to mate with a socket or similar mounting connection. A bolt passes through the adapter, inserted from the lower mounting end with the bolt head stopped and accessible on the lower end of the adapter, and the threaded end of the bolt extending through and protruding from the plug portion into the hollow glass bulb interior. The threaded end of the bolt is initially partway threaded through a flexible retaining member, for example in the shape of a relatively thick, flexible rubber strip having a width greater than the opening in the base of the bulb. The threaded end of the bolt is secured to the flexible retaining piece by a threaded passage or nut on the retaining piece.

The adapter assembly is preferably pre-assembled by inserting the bolt through the adapter, and by initially threading an end portion of the bolt into the nut on the retaining strip. One end of the flexible retaining strip is first inserted endwise into the base of the bulb, and then the adapter is rotated into alignment with the base of the bulb so that the other end of the flexible retaining strip is folded and pushed through. With the flexible retaining strip seated on the inside surface of the base of the bulb, the bolt head is rotated to work the threaded shank through the nut on the retaining strip inside the bulb, thereby drawing the adapter into engagement with the opening at the base of the bulb. The length and thickness of the flexible retaining piece prevents it from being drawn back through the opening.

In a preferred form the adapter is a cylindrical plastic piece, whose lower end is adapted to fit into a tubular socket so that the attached bulb is mounted to whatever upright support is provided, such as a sprinkler head.

These and other features and advantages of the invention will become apparent upon further reading of the specification in light of the accompanying drawings.

BRIEF DESCRIPTION OF THE DRAWINGS

FIG. 2 is an exploded perspective view of the adapter according to the invention and its relationship to the base or stem of a glass gazing bulb as shown in FIG. 1;

FIG. 3 illustrates the pre-assembled adapter components of FIG. 2 being inserted into the base of the gazing bulb.

DETAILED DESCRIPTION OF THE ILLUSTRATED EMBODIMENTS

Figure 1:
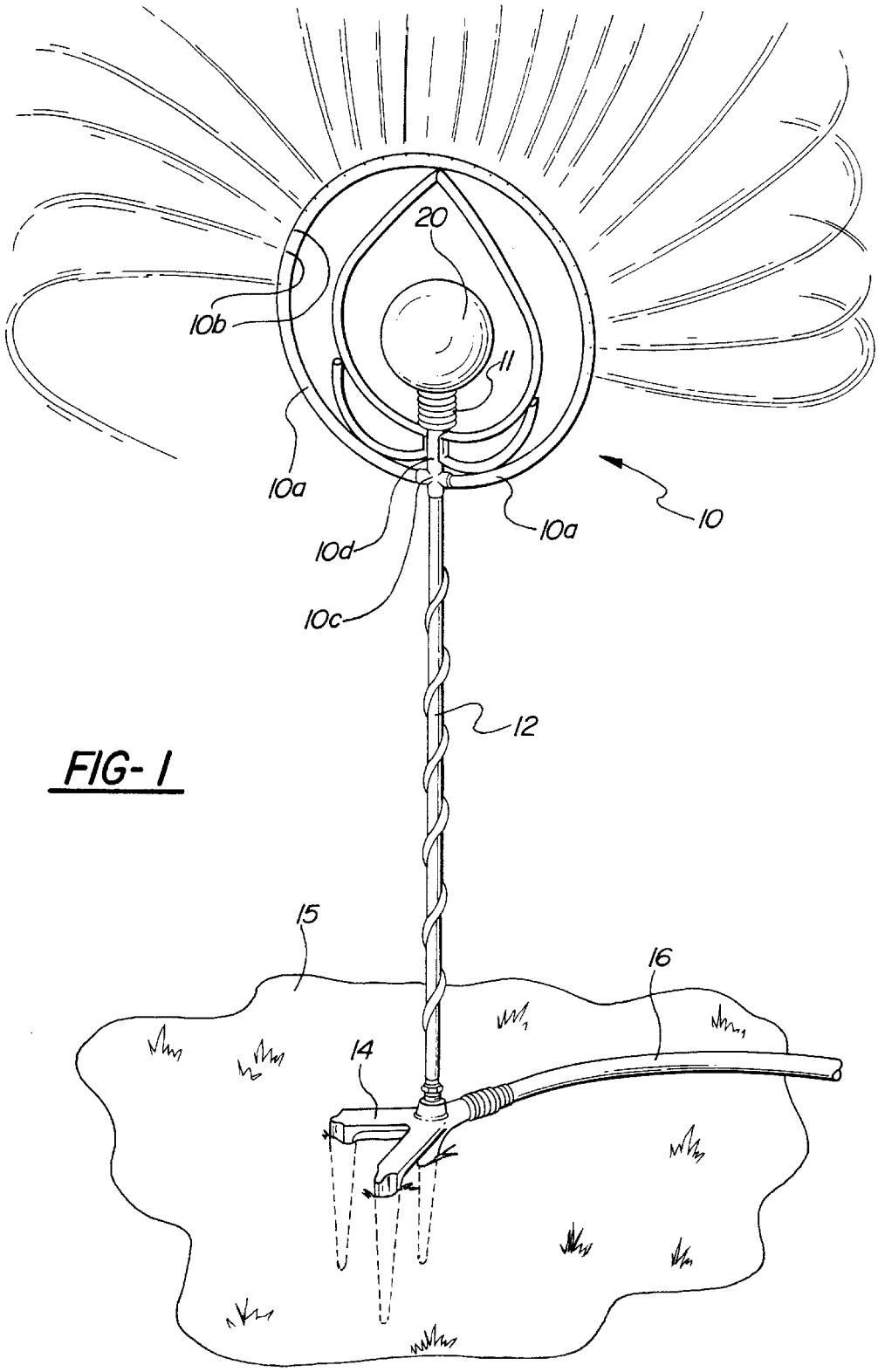
FIG. 1 is a perspective view of an upright, standpipe-type sprinkler with an ornamental glass bulb attached according to the invention.

Referring first to FIG. 1, a decorative upright lawn sprinkler of generally known type is shown comprising a sprinkler head 10 rotatably mounted on a water-transporting standpipe 12 secured to a base 14 anchored in lawn 15. Water is supplied to the standpipe by garden hose 16 attached to a water passage in base 14. The details of base 14 are disclosed in a co-pending patent application assigned to the assignee of the present application. Likewise, the rotatable connection between sprinkler head 10 and standpipe 12 is the subject of another co-pending patent application assigned to the assignee of the present application.

Sprinkler head 10 comprises water conducting tubing 10*a* formed in a circle and connected at its ends to a T-fitting 10*c* to receive pressurized water from standpipe 12. Holes 10*b* formed on the upper half of water tubing 10*a* emit the pressurized water in a desired spray pattern which causes sprinkler head 10 to rotate on standpipe 12.

The upper end of T-fitting 10*c* forms a tubular, blind bore socket 10*d* opening upwardly to receive the base of a hollow glass gazing ball 20. The connection between the base of gazing ball 20 and socket 10*b* is hidden by an ornamental collar 11, in the illustrated embodiment a spiral of decorative copper tubing.

Referring next to FIG. 2, an adapter assembly 30 according to the invention is shown in exploded relationship relative to the base 20*a* of gazing ball 20. Adapter assembly 30 comprises an adapter body 31, a bolt 32, a flexible retaining piece 33 and a nut 34. In the illustrated embodiment adapter body 31 is made from a known plastic material such as nylon; bolt 32 is a common metal bolt; retaining piece 33 is formed from a flexible rubber material; and nut 34 is a "T-nut" of a well-known and commercially available type. It will of course be understood that the materials of these components can vary, for example substituting various plastics for metals, and vice versa, and various soft, non-scratching flexible materials with "grip" on a glass surface for the preferred rubber of retaining piece 33.

Adapter assembly 30 is pre-assembled in the following order, before it is attached to gazing ball 20.

First, bolt 32 is inserted threaded end first through opening 31*d* in adapter body 31, until its threaded end 32*b* protrudes from plug end 31*a*. Nut 34, which normally has already been secured in known fashion in the opening 33*a* of retaining piece 33, is then threaded onto the threaded end 32*b* of bolt 32, just sufficiently to maintain nut 34 and the attached retaining piece 33 secured to the end of the bolt.

Referring next to FIG. 3, a first end 33*b* of flexible retaining piece 33 is inserted endwise through opening 20*b* in base 20*a* of gazing ball 20, up to its midpoint where bolt 32 is threaded into nut 34. Adapter assembly 31 is then rotated downwardly into axial alignment with the opening and pushed inwardly in an axial direction shown by the arrow, with the result that opposite end 33*c* of flexible retaining piece 33 is folded axially against bolt 32 so that it can be inserted inside gazing ball 20 until plug portion 31*a* of the adapter enters opening 20*b* and annular shoulder 31*b* abuts rim 20*c*.

It will be understood from the foregoing that the length of bolt 32, adapter body 31, base 20*a*, and the length of flexible retaining piece 33 are proportioned to permit the above-described insertion of the retaining piece into the gazing ball. In particular, the threaded portion 32*b* of bolt 32 protruding from adapter body 31 must be sufficiently long to permit the pivoting insertion of the flexible retaining piece 33 as described above when its endmost portion is threaded into nut 34. Preferably, just the tip portion of bolt 32 is threaded into nut 34, such that little or none of the bolt tip protrudes from the opposite side of nut 34, thereby allowing the initial insertion of end 33*b* of the retaining piece while preventing contact between the metal bolt and glass base 20*a*. The length of threaded portions 32*b* extending beyond adapter body 31 then also provides sufficient clearance between the adapter body and the gazing ball base to permit the adapter body to be rotated down into axial alignment with base 20*a* for the insertion of the second half 33*c* of the retaining piece into the gazing ball.

After the adapter body is rotated into alignment with base 20*a*, however, the length of bolt 32*b* between nut 34 and adapter body 31 allows the adapter body axial play relative to base 20*a*. This is of course undesirable for the final assembly of the gazing ball. Accordingly, the adapter body 31 is pulled away from gazing ball 20 until the now-unfolded flexible rubber retaining piece 33 engages the inside wall of the gazing ball astride base 20*a*, thereby anchoring the nut sufficiently to permit bolt 32 to be rotated, thereby pulling adapter body 31 into base 20*a* with retaining piece 33 tensioned against the inside wall of the gazing ball. This is best shown in FIG. 4.

Figure 4:
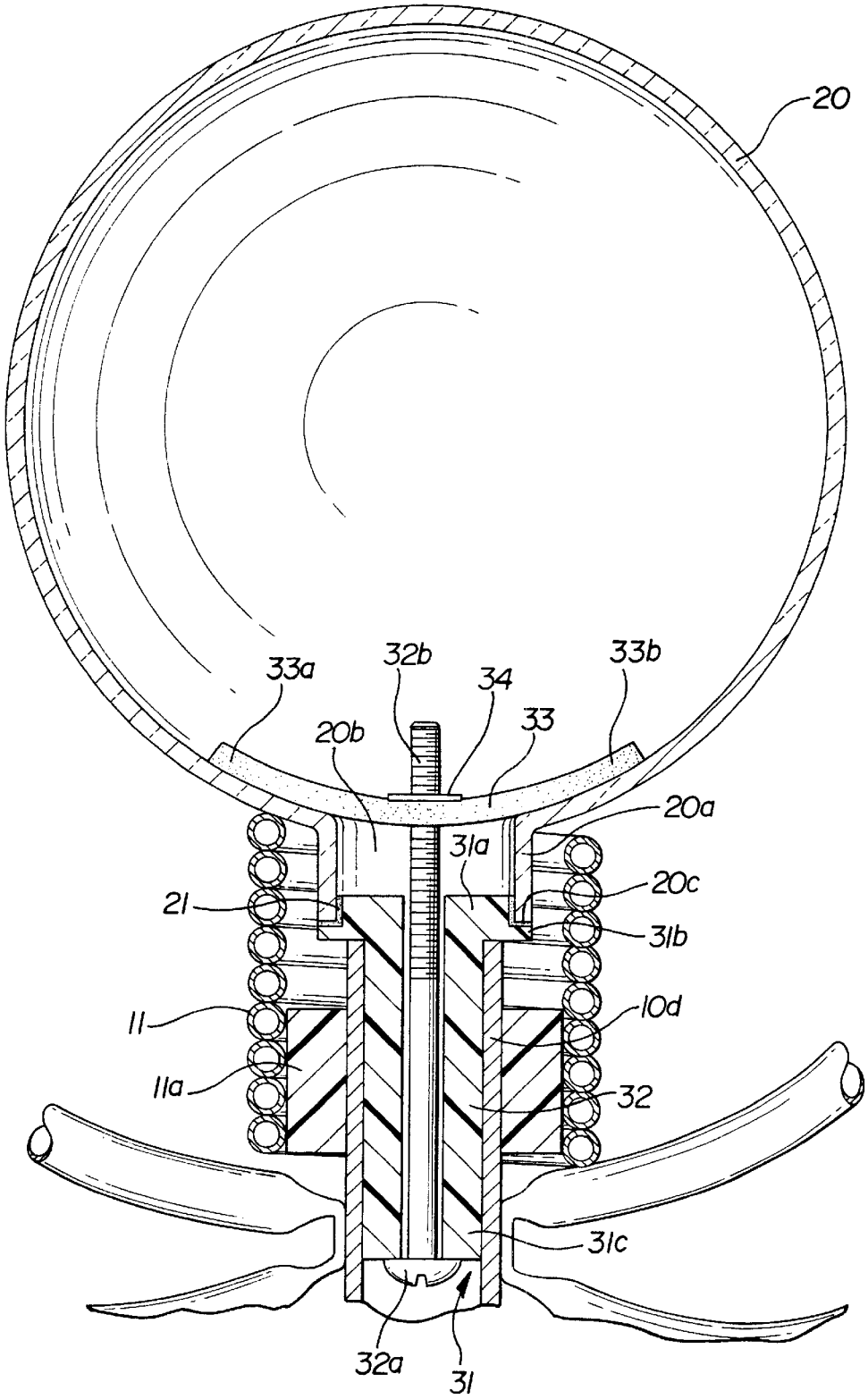
FIG. 4 is an elevational view of the assembled gazing bulb, adapter, and sprinkler head socket of FIG. 2, in section.

In FIG. 4, bolt 32 has been threaded through nut 34 to hold retaining piece 33 in tensioned engagement with the interior of the gazing ball, thereby retaining plastic adapter body 31 securely in base 20*a* with cylindrical plug portion 31*a* in a close coaxial fit with the inside wall of opening 20*b*, and with annular shoulder 31*b* abutting rim 20*c*. This mechanical connection between adapter body 31 and the glass gazing ball socket 20*a* is sufficiently strong for most applications. However, if desired, the connection can be further strengthened and sealed with an adhesive or sealant 21 applied to the junction between the plastic adapter body and the glass gazing ball socket.

It will be understood that although the preferred rubber material of retaining piece 33 can be replaced with a different flexible material, the material used should be sufficiently soft and have sufficient tackiness or "grip" on the interior glass surface of gazing ball 20 to anchor the strip sufficiently for the tightening of bolt 32 through nut 34 as described above. The flexibility and softness of retaining piece 33 also helps it conform to the curved inside surface of the gazing ball and prevents scratching or gouging which might weaken the integrity of the relatively delicate, thin-walled glass ball or bulb.

The assembled gazing ball 20 and adapter can then be mounted into tubular socket 10*d* on the sprinkler head. In the illustrated embodiment, socket-mounting adapter portion 31*c* on the adapter has a diameter sized to provide an interference fit inside tubular socket 10*d* so that gazing ball 20 rotates with the socket and sprinkler head.

The adapter connection between base 20*a* of gazing ball 20 and sprinkler head socket 10*d* can be covered with a decorative collar such as that shown at 11, for example formed from coiled copper tubing. Cover 11 may include a collar portion 11*a*, for example formed from plastic inserted in a friction fit inside collar 11, with a bore adapted to fit over the outside of tubular socket 10*d*. The upper end of collar 11 has a larger inside diameter to fit over base 20*a*.

It will be understood by those skilled in the art that while an adapter designed for a friction fit in a tubular socket 10*d* has been illustrated, the inventive adapter can be shaped to mate with other types of connection, and is not limited to the cylinder shape of body 31*c*. Nor is the invention limited to a cylindrical gazing ball stem or base 20*a* as shown, but adapter 31 can be shaped to fit almost any size and shape opening 20*b* used with gazing balls, glass bulbs, and the like. It will also be understood that although the illustrated embodiment shows connection to a glass gazing ball 20, hollow decorative objects made from other materials can also be secured to sprinkler heads with the inventive adapter 30 in a manner which will be within the ability of those skilled in the art now that we have disclosed a specific embodiment of the invention. Also, although the preferred embodiment has been illustrated in use with a sprinkler head support, the invention is useful for attaching gazing balls and the like to other supporting structures. These and other modifications will therefore be apparent in light of the foregoing description, and still lie within the scope of the following claims.

Accordingly, we claim:

1. An adapter assembly adapted to be secured to a hollow ornament having a base with an opening to the interior of the ornament, the adapter assembly providing a connecting portion at the base of the ornament for mounting to a support, comprising:

an adapter body comprising a plug portion for axial engagement with the opening in the base of the ornament, an annular shoulder portion for abutting the base of the ornament surrounding the opening, and a connecting portion extending from the annular shoulder portion, the connecting portion mountable to a support;

a bolt rotatably mounted through the adapter body such that a threaded end of the bolt extends from the plug portion; and a flexible retaining piece including a threaded passage for threaded engagement with the threaded end of the bolt protruding from the plug portion of the adapter body, the flexible retaining piece comprising an elongated piece of rubbery material having a length sufficient to straddle the opening in the ornament base in the interior of the ornament, and a width less than a width of the opening in the ornament base for endwise insertion therein.

2. The adapter assembly of claim 1, wherein the threaded passage in the flexible retaining piece comprises a nut secured therein.

3. The adapter assembly of claim 1, wherein the connecting portion of the adapter body comprises a cylindrical member adapted to be rotatably mounted in a tubular socket.

4. The adapter assembly of claim 1, wherein the adapter body is made from a plastic material, and wherein the ornament is made from glass.

5. The adapter assembly of claim 1, wherein the threaded end of the bolt extending from the plug portion has a length sufficient to allow endwise insertion of a first end of the flexible retaining piece into the ornament interior through the opening in the base when a tip of the threaded end is threaded into the flexible retaining piece.

6. An ornament assembly for a standpipe sprinkler adapted to be secured to a socket provided on a standpipe sprinkler, comprising:

a hollow glass ornament having a base with an opening to the interior of the ornament;

an adapter body comprising a plug portion for axial engagement with the opening in the base of the hollow glass ornament and a connecting portion extending from the base exteriorly of the ornament;

a bolt rotatably mounted through the adapter body such that a threaded end of the bolt extends from the plug portion through the base opening into the interior of the hollow glass ornament;

a flexible retaining piece including a threaded passage for threaded engagement with the threaded end of the bolt extending from the plug portion of the adapter body, the flexible retaining piece comprising an elongated piece of rubbery material having a length sufficient to straddle the opening in the interior of the ornament, and a width less than a width of the opening in the base of the ornament, wherein the threaded end of the bolt is threaded through the flexible retaining piece when the adapter body is engaged with the opening in the base of the hollow glass ornament, such that the flexible retaining piece is tensioned against the inside surface of the hollow glass ornament adjacent the opening.

7. A method for securing a hollow glass ornament to a socket structure provided on a standpipe sprinkler, the hollow glass ornament having a base with an opening to the interior of the ornament, the method comprising the following steps:

providing an adapter body having a plug portion for axial engagement with the opening in the base of the ornament;

inserting a bolt through the adapter body such that a threaded end of the bolt extends from the plug portion;

threadably securing a flexible retaining piece of rubbery material to a tip of the bolt, the flexible retaining piece comprising an elongated strip of rubbery material having a length sufficient to straddle the opening in the ornament base, and a width less than a width of the opening in the ornament base;

inserting a first end of the flexible retaining piece in endwise fashion into the opening in the ornament base;

rotating the adapter body and bolt into axial alignment with the opening in the ornament base;

axially inserting the adapter body, bolt, and a second end of the flexible retaining piece into the interior of the ornament through the opening in the base; and, drawing the flexible retaining piece against an inside surface of the ornament astride the opening, and threading the bolt further through the flexible retaining piece to draw the adapter body into engagement with the base of the ornament with the flexible retaining piece tensioned against an inside surface of the ornament.

* * * * *